United States Patent [19]

Jones

[11] 3,955,622

[45] May 11, 1976

[54] DUAL DRILL STRING ORIENTING APPARATUS AND METHOD

[75] Inventor: Howard W. Jones, Long Beach, Calif.

[73] Assignee: Regan Offshore International, Inc., Torrance, Calif.

[22] Filed: June 9, 1975

[21] Appl. No.: 585,376

[52] U.S. Cl. ..... 166/.5; 166/75 A; 166/85; 251/1 A; 285/28

[51] Int. Cl.[2] ..... E21B 33/03

[58] Field of Search ..... 166/75 A, 75 R, .5, 166/.6, 77, 243, 82, 86, 89, 85; 175/7; 33/180 R; 285/25, 27; 228/49; 251/1 R, 1 A

[56] References Cited

UNITED STATES PATENTS

| | | | |
|---|---|---|---|
| 3,072,420 | 1/1963 | Lebeaux et al. | 166/75 A X |
| 3,412,789 | 11/1968 | Ralph et al. | 166/.6 |
| 3,554,278 | 12/1970 | Reistle et al. | 251/1 A |
| 3,884,298 | 5/1975 | Watkins | 166/.5 |

*Primary Examiner*—Frank L. Abbott
*Assistant Examiner*—Richard E. Favreau

[57] ABSTRACT

Apparatus and method for orienting a pair of drill strings or the like in a predetermined manner in the center of a bore through a blowout preventer. The drill strings extend from a vessel floating on the surface of a body of water down through the preventer into a subsea wellhead installation. A first pair of opposed rams are actuated to move the drill strings into a predetermined central zone of the bore through the blowout preventer. These first rams operate under a predetermined maximum compressive force of the rams on the drill strings. Above this force, a second pair of opposed rams are activated to move the drill strings out of the predetermined central zone and into a final centrally oriented zone in the bore through the blowout preventer regardless of the position of the drill strings in the central zone. In this manner, the closing off of the drill strings with respect to the wellhead is facilitated since a proper orientation of the drill strings in the bore through the blowout preventer is provided prior to actuating the blowout preventer.

27 Claims, 11 Drawing Figures

Fig. 2.
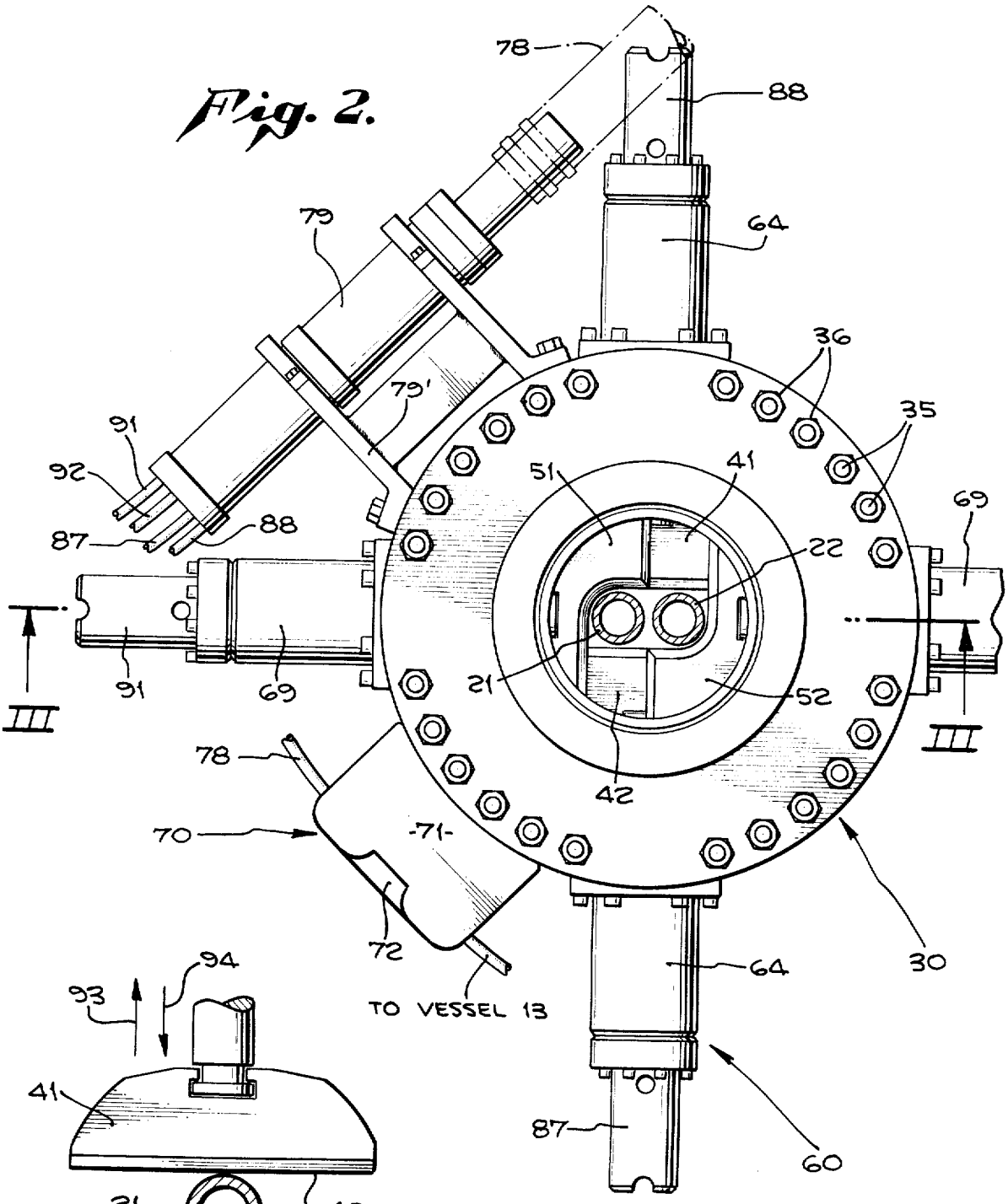
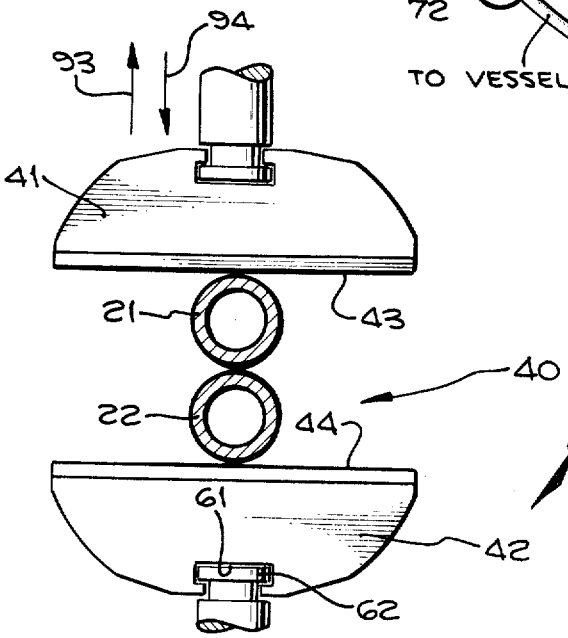
Fig. 4.

DUAL DRILL STRING ORIENTING APPARATUS AND METHOD

BACKGROUND OF THE INVENTION

1. Field of the Invention

The invention relates to subsea wellhead assemblies; and, more particularly, to apparatus and method for orienting a pair of drill strings within a blowout preventer which drill string extends from a vessel floating on the surface of a body of water down into a subsea wellhead assembly.

2. Description of the Prior Art

In the oil well industry, certain assemblies have been used for drilling oil wells in subsea locations. Generally, such assemblies include a riser carrying a string of drill pipe used to carry out the drilling operations. The string of pipe extends through a conventional B.O.P. stack down into the well borehole.

In certain subsea operations, it may be desirable to have more than one string of oil well drilling or production pipe extending through the riser and through one or more blowout preventers down into the subsea wellhead. If a single drill string is used, when the blowout preventer is actuated, it seals around the single drill string. However, when dual drill strings are provided, in order to obtain a proper and effective seal of the blowout preventer about the dual drill strings, it is necessary that they be initially moved to a central position within the bore extending through the blowout preventer. If they are not in this position when the blowout preventer (or preventers) is actuated, the dual drill strings may not be completely sealed off from the subsea well which might result in considerable damage to equipment or the like as the pressures build up during drilling operations. Heretofore, no satisfactory means have been found for properly orienting dual drill strings in the bore through a blowout preventer without deforming or crushing the drill strings.

SUMMARY OF THE INVENTION

It is an object of this invention to provide apparatus and method for orienting a pair of drill strings in a predetermined manner in the center of a bore through a blowout preventer associated with a subsea wellhead installation.

It is a further object of this invention to provide apparatus and method for first linearly aligning a pair of drill strings in a predetermined zone within a bore through a blowout preventer, then moving the drill strings into a final centrally oriented zone within a blowout preventer without crushing or deforming the drill strings.

It is a further object of this invention to provide a method and apparatus for carrying out the foregoing objects while controlling the compressive forces acting on the drill strings when moving them to the final centrally oriented zone.

These and other objects are preferably accomplished by providing a first pair of opposed rams which are activated to move the drill strings into a predetermined zone of the bore through the blowout preventer. These first rams operate under a predetermined maximum compressive force of the rams on the drill strings. Above this force, a second pair of opposed rams are activated to move the drill strings out of the predetermined zone and into a final centrally oriented zone in the bore through the blowout preventer regardless of the position of the drill strings in the central zone. In this manner, the closing off of the drill strings with respect to the wellhead is facilitated since a proper orientation of the drill strings in the bore through the blowout preventer is provided prior to actuating the blowout preventer.

BRIEF DESCRIPTION OF THE DRAWING

FIG. 2 is a horizontal view, partly in section, of a portion of the apparatus of FIG. 1 taken along lines II—II thereof;

FIG. 4 is a top plan view of the apparatus of FIGS. 2 and 3, with portions thereof omitted for convenience of illustration, showing a possible first position on the operation of the apparatus in accordance with the invention;

DESCRIPTION OF THE PREFERRED EMBODIMENT

Figure 1:
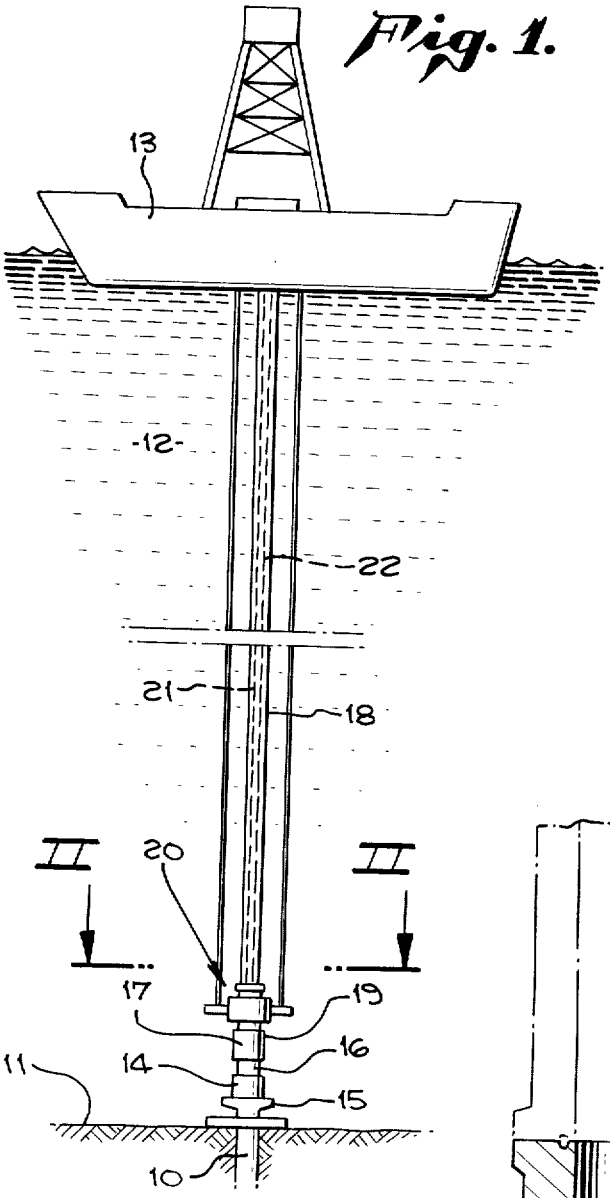
FIG. 1 is an elevational view of apparatus in accordance with the present invention associated with a blowout preventer of a wellhead assembly positioned generally above a subsea well.

Referring now to the drawings and more particularly to FIG. 1, a well borehole 10 is shown drilled into the ocean floor 11 beneath the ocean 12 from a floating platform, vessel, tower or the like 13 located at the surface of ocean 12 as is well known in the subsea drilling art.

The well borehole 10 has located thereover a conventional wellhead 14 which typically includes a drilling template 15. It is to be understood that template 15 normally includes a central bore (not shown) with an internal passageway (also now shown) extending therethrough communicating with the ocean 12, which passageways and bore may then be filled with concrete is well known in the drilling art.

A conventional Christmas tree unit 16 is mounted in fluid communication with wellhead 14. One or more conventional blowout preventers such as B.O.P. preventer 17, may be mounted on unit 16. It is to be understood that suitable fluid supply and return lines (not shown) may be associated with preventer 17 and vessel 13 as is well known in the art.

A conventional riser 18 extends from vessel 13 to wellhead 14. As particularly contemplated in the present invention, means 20 are provided for orienting a pair of drill strings which extend from vessel 13 through preventer 17 to wellhead 14. Generally, a single rotatable string of drilling pipe extends through such preventers and have the lower end of the lowermost pipe connected to a casing running tool (not shown) disposed within hanger supporting tool 19 which is in turn coupled to well borehole 10 all as is well known in the art. However, it is desirable in certain drilling operations to have more than one string of drilling pipe running down the riser through the blowout preventers to the well borehole. A single drill pipe may be sealed off from the wellhead by actuating a blowout preventer, but it is extremely difficult to seal off a pair of drill strings in this manner. The pair of drill pipes must be oriented in such a manner within the preventer so that they are completely and totally sealed off after actuation of the preventers.

As used throughout this specification, the term "drill string" is used to refer to any conventional oil well drilling or production pipes. Further, although a single preventer 17 is shown, obviously more than one preventer may be provided.

Accordingly, means 20 arranges both drill strings 21, 22 extending through preventer 17 in both a generally symmetrical relationship with respect to the longitudinal axis of the preventer 17 and in a linear relationship. Thus, means 20, in an exemplary embodiment of the invention, includes drill string receiving means 30 for receiving the drill strings 21, 22 therethrough, first drill string positioning means 40 for initially moving the drill strings into a predetermined central zone in the bore of the preventer 17 in a first linear relationship, second drill string positioning means 50 for subsequently moving the drill strings into a second linear relationship generally symmetrically arranged about the central longitudinal axis of the preventer 17, and actuating means 60 for moving the positioning means 40, 50 without deforming or crushing drill strings 21, 22.

Figure 3:
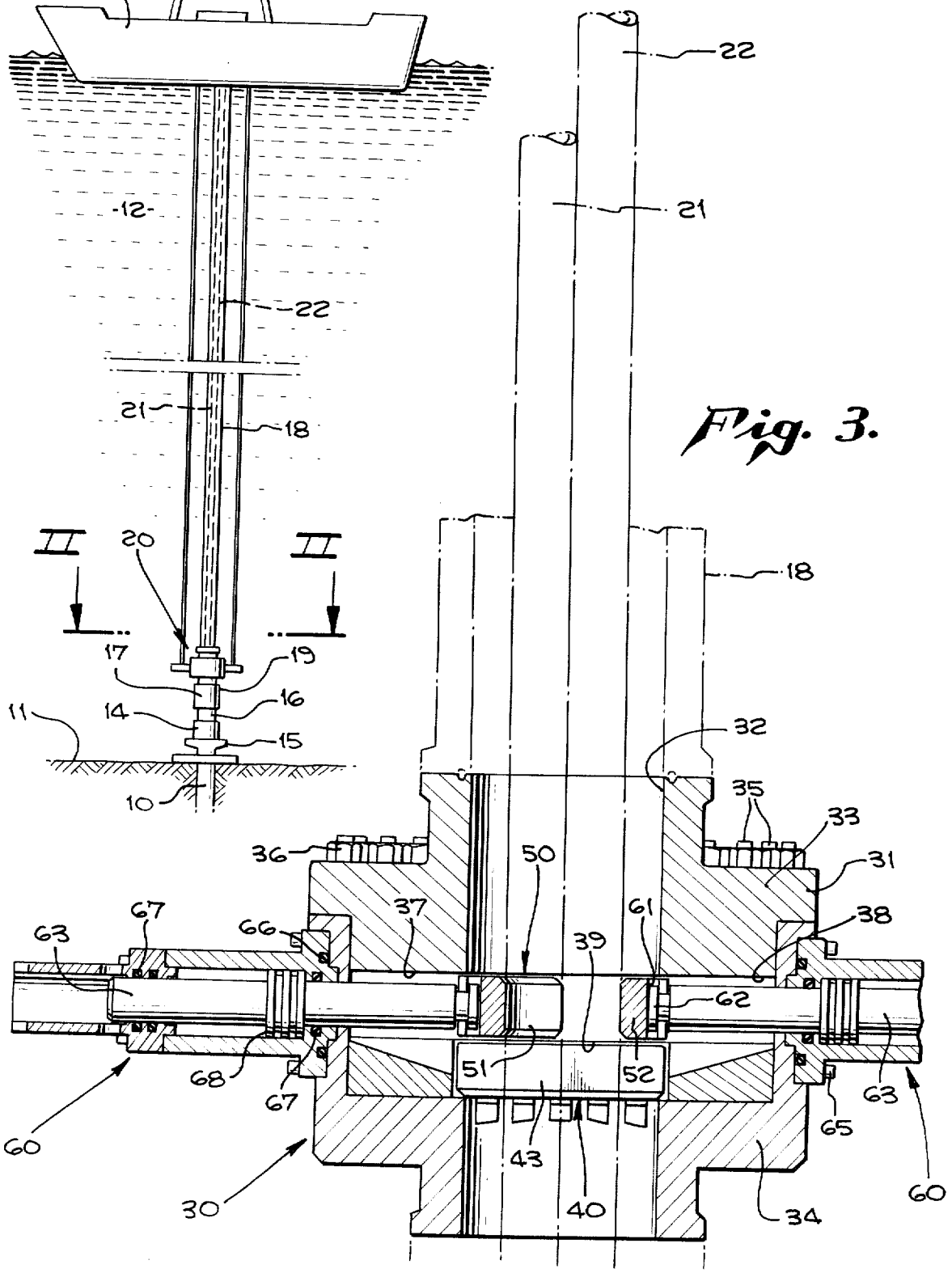
FIG. 3 is a sectional view taken along the lines III—III of FIG. 2.

Referring now particularly to FIGS. 2 and 3, as particularly contemplated by the invention, drill string receiving means 30, in an exemplary embodiment of the invention, includes a housing 31 which may be welded or otherwise secured to the lower end of riser 18. Housing 31 has a throughbore 32 of a diameter preferably the same as the internal diameter of the riser 18 and the preventer 17. It is to be understood that the lower end of housing 31 is secured to the preventer 17 and the Christmas tree assembly 16 in a manner well known in the drilling art. Preferably, housing 31 is comprised of two mating parts 33 and 34 which may be secured together by bolts 35 and nuts 36 or the like. A pair of passageways 37, 38 extend through housing 31 generally transverse to the longitudinal central axis of housing 31 (indicated by the line of abutment of drill strings 21, 22 in FIG. 3). A like pair of passageways 39 (only one visible in FIG. 3) extend through housing 31 below and generally transverse to passageways 37, 38.

It is to be understood that the position of drill strings 21, 22 as will be discussed, in FIGS. 2 and 3, is the final desired centrally oriented position of these strings 21, 22 within housing 31.

Referring now more particularly to FIGS. 2 through 4, as particularly contemplated in the present invention, first drill string positioning means 40 are shown for initially moving the drill strings 21, 22 into a predetermined central zone of housing 31 which zone also corresponds with the bore of preventer 17. Thus, in the exemplary embodiment of the invention, first positioning means 40 includes a pair of oppositely disposed drill string positioning ram means 41, 42 preferably having planar drill string abutting surfaces 43, 44. Passageways 39 are preferably configured to receive ram means 41, 42 therein in sliding relationship so that the ram means 41, 42 do not extend into throughbore 32 when in their first retracted position permitting tools or the like to be passed from vessel 13 down riser 18 through throughbore 32 and preventer 17 without interference.

Figure 5:
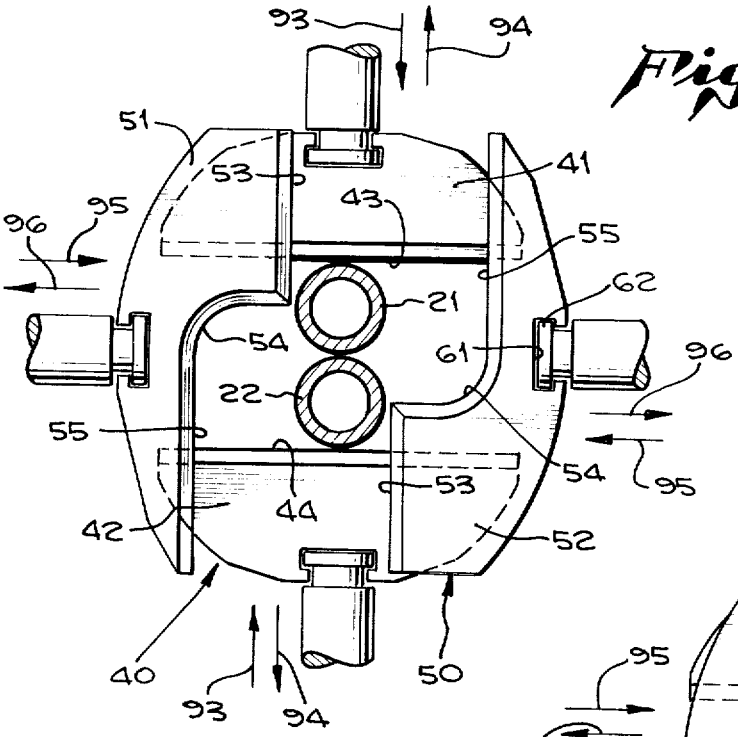
FIG. 5 is a top plan view, similar to FIG. 4, with portions added thereto to show the components in a possible second position for carrying out the invention.

Referring now more particularly to FIGS. 2, 3 and 5, as particularly contemplated by the present invention, second drill string positioning means 50 are provided for moving the drill strings 21, 22 into the desired final centrally oriented position after they are linearly aligned as in either FIGS. 4 and 8 (i.e. regardless of their orientation after actuation of first ram means 41, 42) as will be discussed shortly. Thus, in the exemplary embodiment of the invention, second positioning means 50 includes a pair of oppositely disposed positioning ram means 51, 52 which, as will be discussed, move in a direction generally normal to the direction of movement of the first positioning means 40. Further, second positioning means 50, as particularly contemplated by the present invention, includes orienting means 56 for orienting the drill strings 21, 22 in the final central oriented position regardless of their linear arrangement after actuation of ram means 41, 42 (i.e., either the FIG. 4 or the FIG. 8 position). In the exemplary embodiment, such orienting means 56 includes each ram means 51, 52 having a first generally planar drill string abutting surface 53, a second generally arcuate drill string abutting surface 54 and a third generally planar drill string abutting surface 55. Surface 55 lies in a plane generally parallel to, but spaced from, the plane of surface 53 as clearly shown in FIG. 5. As shown in FIG. 2, surface 54 is preferably configured to receive therein in abutting relationship an arcuate portion of each drill string 21, 22, as for example, approximately one-quarter of the outer diameter thereof. The spacing between the junction of the first and second surfaces 53, 54 of one of the ram means 51, 52 as ram means 51, and the junction of the first and second surfaces 53, 54 of the other ram means (e.g., ram means 52) is slightly greater than the diameter of the drill strings 21, 22 when in the final centrally oriented or FIG. 2 position. Again, passageways 37, 38 are configured to receive ram means 51, 52 therein in sliding relationship so that the ram means 51, 52 do not extend into throughbore 32 when in their first retracted position permitting tools or the like to be passed frrom vessel 13 down riser 18 and through throughbore 32 and preventer 17 without interference.

Referring once again to FIGS. 2, 3, and 7, means 20 includes actuating means 60 for moving first and second drill string positioning means 40, 50 from a first, retracted position out of throughbore 32 to a second, extended position engaging and abutting against drill strings 21, 22. In the exemplary embodiment, such actuating means 60 includes Tee-shaped apertures 61 on each positioning ram means 41, 42, 51, and 52 (see particularly FIG. 7) for receiving therein a Tee-shaped portion 62 (FIGS. 3 and 7) of a piston rod 63 (see particularly FIG. 3). Each rod 63 is slidably mounted in each passageway 37 through 39 and extends into piston cylinders 64 (associated with first ram means 41, 42) and cylinders 69 (associated with second ram means 51, 52) secured to housing 31 by suitable nuts and bolts 65 or the like. Suitable O-rings 66 may be associated with each cylinder 64 or 69 and its connection to housing 31. Like O-rings 67 may be associated with rods 63 in cylinders 64 or 69. Each piston rod 63 includes suitable piston rings 67 in sliding contact with the inner cylinder wall.

It will be appreciated that supplying fluid to each cylinder 64 or 69, as will be discussed, moves each ram means 41, 42, 51 and 52 from a first, retracted position to a second, extended position. Further, actuating means 60, as particularly contemplated in the present invention, further includes compressive force control means 70 for controlling the compressive force of the ram means 41, 42 on drill strings 21, 22. In the exemplary embodiment, as seen in FIG. 2, control means 70 includes a valve plate 71 connected to housing 31 in any suitable manner and a bracket flow divider assembly 79 also connected via bracket 79' to housing 31 in any suitable manner. As shown more particularly in FIGS. 10 and 11, valve plate 71 may include a sequence valve assembly 72 associated therewith which includes a Y-shaped passageway 73 having a fluid line 74 coupled at one end to the main branch portion 75 of assembly 72 and at the other end to a suitable source of pressurized fluid on vessel 13. One of the branches 76 includes a suitable valve 77 therein, which valve is normally open, so that pressurized fluid may be flowed, via line 78, to flow divider assembly 79 (see also FIG. 2). Assembly 79 includes a main piston cylinder 80 which piston rod 81 simultaneously moves a pair of piston cylinders 82 and 83 via connecting rod 84. That is, the piston rod 81 of main cylinder 80 is connected to rod 84 which in turn is connected to piston rods 85 and 86 of each cylinder 82 and 83. Thus, when pressurized fluid from vessel 13 enters line 78 and assembly 79, it simultaneously moves each rod 85, 86 when rod 81 is moved. Fluid in each clyinder 82, 83 enters fluid lines 87, 88 respectively, to cylinders 64. Thus, cylinders 64 of each first ram means 41, 42 are activated to thereby move ram means 41, 42 simultaneously and at the same rate of speed so that the ram means 41, 42 move from a first, retracted position out of throughbore 32 to a second, extended position approximately the same distance across throughbore 32. Control means 70 further includes valve 77 being a suitable valve that remains open until a predetermined compressive force of the first ram means 41, 42 on drill strings 21, 22 is reached. For example, valve 77 may remain open until a compressive force of about 800 to 1200 psi is reached, then close.

Valve 89, however, in the branch 90 of Y-shaped passageway 73, is normally closed and adapted to open when a predetermined compressive force is reached, again, as for example, about 800–1200 psi. Thus, as will be discussed, drill strings 21, 22 may be moved into desired position in throughbore 32 without deforming or crushing drill strings 21, 22, which may withstand a compressive force substantially above about 800–1200 psi, as for example, about 1400 psi. Valve 89 may be adapted to be closed when a predetermined compressive force of second ram means 51, 52 on drill strings 21, 22 is reached, as for example, about 1200 psi. However, since the drill strings 21, 22 are initially aligned by first ram means 41, 42, it is not necessary to control the compressive force of the second ram means. However, as the second ram means 51, 52 builds up a compressive force on drill strings 21, 22, the compressive force of first ram means 41, 42 is reduced thereby again opening valve 77. Thus, in this manner, as will be discussed, the first and second ram means 41, 42, 51 and 52 are alternately actuated to move drill strings 21, 22 to their final, desired centrally oriented position with respect to throughbore 32 and the bore of preventer 17.

The fluid from branch 90 enters fluid line 91 leading to a main piston cylinder 92 in assembly 79. A common bar 84' is activated by the piston rod 81' to simultaneously activate piston rods 85' and 86' of cylinders 82' and 83'. The fluid enters fluid lines 87' and 88' leading to cylinders 69. Thus, cylinders 69 associated with second ram means 51, 52 are simultaneously actuated by main cylinder 92. For convenience of illustration, the cylinders 64 of first ram means 41, 42 have been indicated in block form in FIG. 11 as cylinders Nos. 1 and 2 (and schematically in FIG. 10) and the cylinders of second ram means 51, 52 have been indicated in block form in FIG. 11 as cylinders Nos. 3 and 4 (and also schematically in FIG. 10). The entire flow divider assembly 72 has been indicated schematically in FIG. 10 by the letter "S".

The operation of means 20 for orienting the dual drill strings 21, 22 in the center of the bore of blow-out preventer 17 will now be described. It is to be understood that, after passing the drill strings 21, 22 through throughbore 32, they may be oriented at any point or zone within throughbore 32.

It is now necessary to properly locate them within throughbore 32, which throughbore 32 is coaxially aligned with the bore of preventer 17, prior to activating preventer 17.

Accordingly, pressurized fluid is passed down line 74 from vessel 13 which fluid passes normally open valve 77 which activates main cylinder 80. Cylinder 80 activates branch cylinders 82, 83 to thereby activate the first drill string positioning means 40 which moves first ram means 41, 42 out of their first, retracted position with respect to throughbore 32 to abut against drill strings 21, 22 and move them to either the position shown in FIGS. 4 or 8. That is, drill strings 21, 22 are either clamped between first ram means 41, 42 is an abutting arrangement linearly aligned in a direction generally parallel to the direction of movement of first ram means 41, 42 (as indicated by arrows 93, 94 in FIG. 4) or disposed between first ram means 41, 42 in either an abutting (not shown) or non-abutting arrangement linearly aligned in a direction generally normal to the direction of movement of first ram means 41, 42 (as indicated by arrows 93, 94). In both cases, first ram means 41, 42 moves drill strings 21, 22 to a predetermined central zone within throughbore 32, which zone is defined by the combined positions illustrated in FIGS. 4 and 8 of drill strings 21, 22 (assuming further that, in the FIG. 8 position, the drill strings 21, 22 may be disposed at any point between the pair of first ram means 41, and 42).

In either case, when the compressive force of first ram means 41, 42 on drill strings 21, 22 reaches the aforementioned predetermined amount, valve 77 cuts out and valve 89 takes over. Drill strings 21, 22 remain disposed between first ram means 41, 42 while the second drill string positioning means 50 are activated to move second ram means 51, 52.

Figure 6:
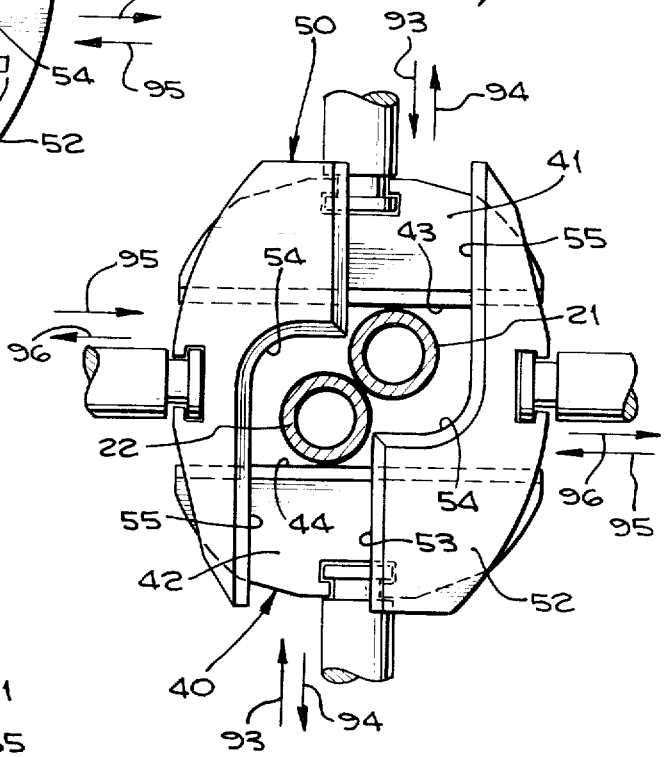
FIG. 6 is a top plan view similar to FIG. 5, showing the components thereof in a possible third position for carrying out the invention.

This is illustrated in FIG. 5 (assuming the drill strings 21, 22 were initially moved into the position shown in FIG. 4) wherein second ram means 51, 52 may be moved from a first, retracted position out of throughbore 32 to a second position abutting against drill strings 21, 22. It can be seen that the orienting means 56 on each second ram means 51, 52 serves to move the drill strings 21, 22 into their final, desired oriented position centrally located in throughbore 32. That is, as second ram means 51, 52 move in the direction of arrows 95, surfaces 53 abuts against the drill strings 21, 22 and, as can be seen in FIG. 6, move the drill strings 21, 22 about each other to a final position shown in FIGS. 2 and 7. This position arranges the drill strings 21, 22 side-by-side and symmetrically about the central longitudinal axis of throughbore 32 and thus properly orienting them with respect to the bore of preventer 17.

Further, as the compressive force of second ram means 51, 52 increases, the compressive force of first ram means 41, 42 on drill strings 21, 22 is reduced. Valve 77 thus kicks in to again activate first ram means 41, 42. Thus, the first and second ram means are alternatively activated to position the dual drill strings 21, 22 within throughbore 32 without crushing or deforming the drill strings 21, 22.

Figure 7:
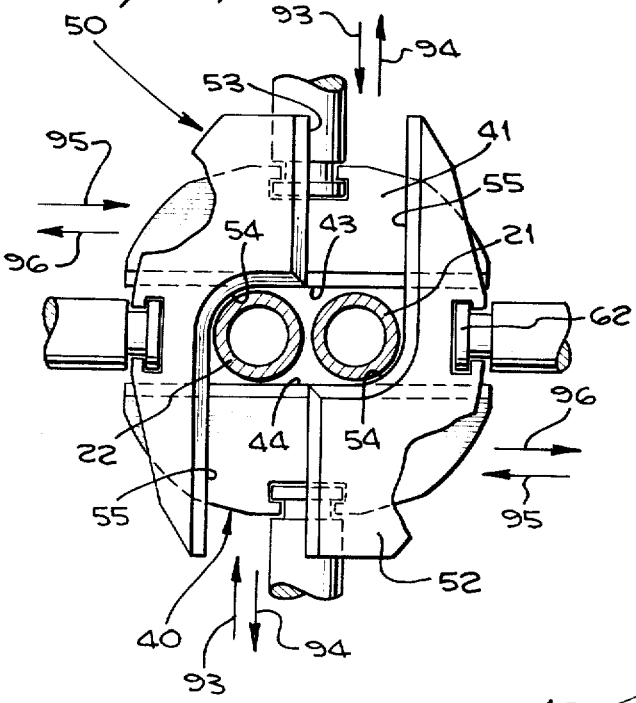
FIG. 7 is a top plan view, similar to FIG. 6 of the final position of the apparatus for carrying out the invention.
Figure 8:
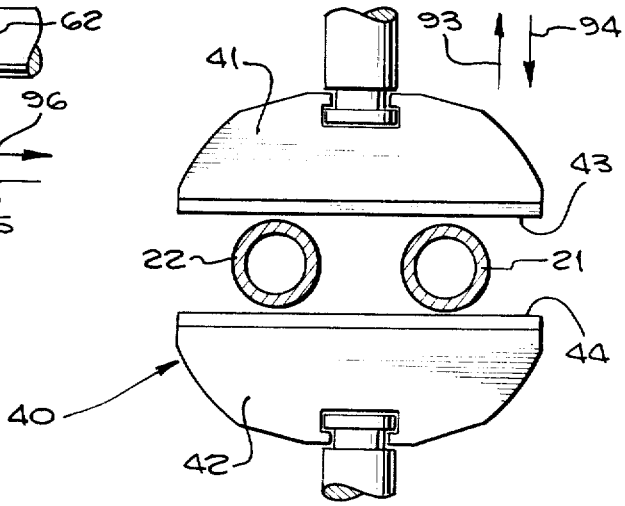
FIG. 8 is a top plan view, similar to FIG. 4, showing an alternate possible first position for carrying out the invention.
Figure 9:
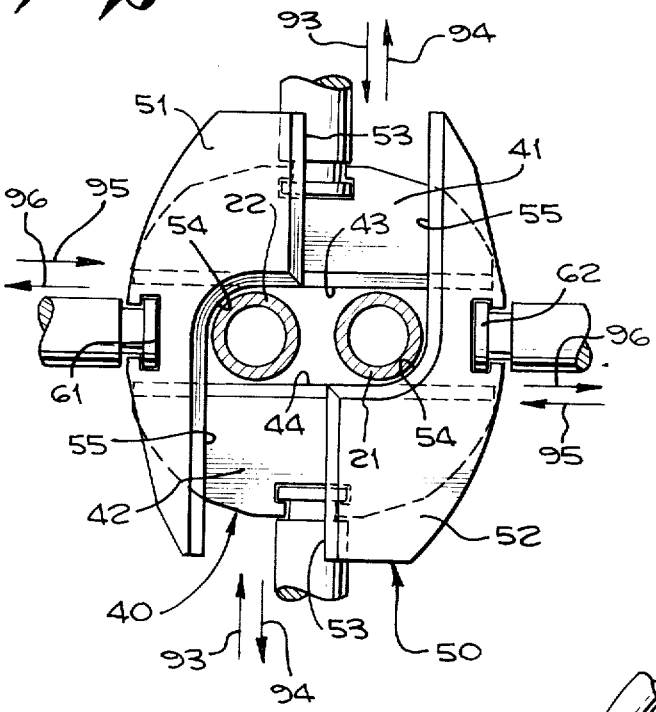
FIG. 9 is a top plan view, similar to FIG. 5, showing the second position of the apparatus after the alternate possible first position of FIG. 8.

If the drill strings 21, 22 at the end of the initial actuation of the first positioning means 40, are aligned as in FIG. 8, when the second positioning means 50 is activated, as shown in FIG. 9, the drill strings 21, 22 are pushed together in a side-by-side relationship, their final position again as shown in FIGS. 2 and 7.

The orienting means 56, which includes the arcuate surfaces 54, assists in moving the drill strings 21, 22 into their final position as is clear from comparing FIGS. 2, 5, 6, 7 and 9. Also, the distance between junctions of surface 54 and surface 53 on each second ram means 51, 52 is slightly greater than the outer diameter of the drill strings 21, 22 to further assist in carrying out the final orientation.

Figure 10:
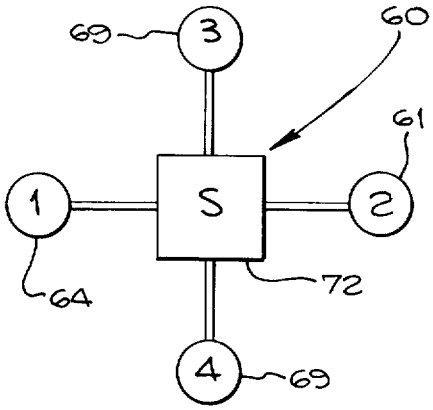
FIG. 10 is a schematic illustration of valving means suitable to carrying out the method and apparatus of the invention.
Figure 11:
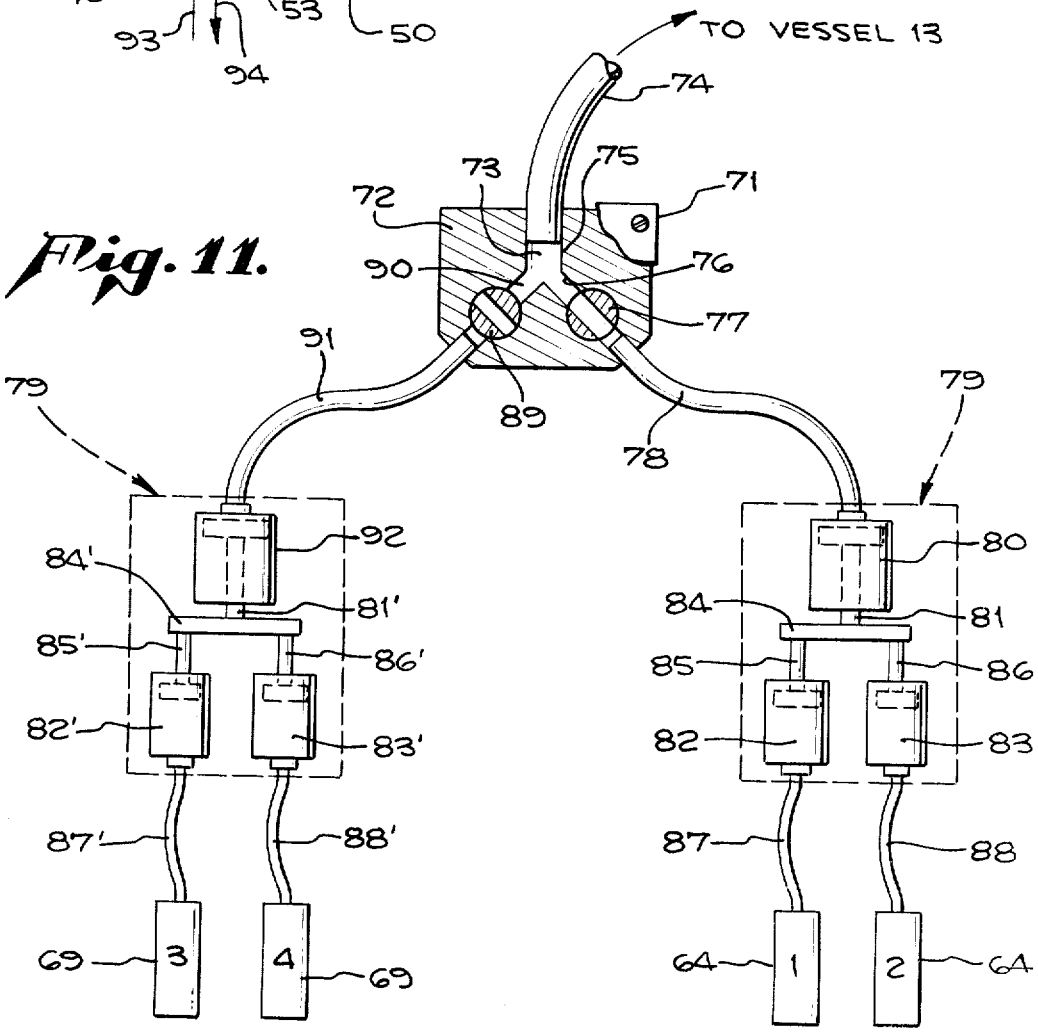
FIG. 11 is a partly diagrammatic illustration of the valving means of FIG. 10.

Thus, as schematically shown in FIG. 10, first ram means 64 (Nos. 1 and 2) are actuated simultaneously via assembly 72 to move across the throughbore 32 at the same rate of speed and the same distance to thereby clamp drill pipes 21, 22 therebetween as shown in FIGS. 4 and 8. Each first ram means 64 extends approximately the same distance within throughbore 32. The second ram means 69 (Nos. 3 and 4) are then activated to either move the drill strings in one movement (FIG. 9) to the final oriented position of FIGS. 2 and 7 or, alternatively along with subsequent re-activation of first ram means 64 to move the drill strings in a series of movements (FIGS. 5 and 6) to the final oriented position of FIGS. 2 and 7.

After the drill strings 21, 22 are properly centrally located within throughbore 32 and thus also properly oriented with respect to preventer 17, the preventer 17 may be activated to thereby move into position surrounding drill strings 21, 22 and sealing the outside thereof off from the well borehole. The fluid pressure in line 74 may be then released to deactivate the first and second positioning means 40, 50 and return the first and second ram means 41, 42, 51 and 52 to their initial retracted position.

Although a particular means have been disclosed for dividing the flow of fluid and actuating the ram means as disclosed, any suitable means may be used. For example, appropriately coordinated fluid lines may be individually connected to each individual ram means.

It can be seen from the foregoing that apparatus and method is disclosed for orienting a pair of drill strings, extending from a vessel floating on the surface of a body of water through one or more blow-out preventers and into a subsea wellhead installation in a predetermined manner in the bore of the preventer or preventers. This facilitates closing off of the drill strings with respect to the wellhead when the preventer is actuated. The techniques of my invention enable dual drill strings to be completely and effectively sealed off from the wellhead installation.

I claim:

1. Apparatus for orienting a pair of drill strings, which extend from a vessel floating on the surface of a body of water down into a subsea wellhead installation, in a predetermined manner in the center of a bore through a blowout preventer to facilitate closing off of the drill strings with respect to the wellhead at the blowout preventer, said apparatus comprising:

first drill string positioning means for positioning said drill strings into a predetermined central zone of the bore through the blowout preventer, said first positioning means including a pair of first opposed ram means operating under a predetermined maximum compressive force of said first ram means on said drill strings adapted to move from a first position out of engagement with said drill strings to a second position engaging said drill strings; and second drill string positioning means for moving said drill strings in said zone into a final centrally oriented position within the bore through the blowout preventer, said second drill string positioning means including a pair of second opposed ram means adapted to move from a first position out of engagement with said drill strings to a second position engaging said drill strings, said second ram means including orienting means for moving said drill strings to said final position whether said drill strings when positioned in said central zone are linearly aligned in a direction extending generally parallel to the direction of movement of said first ram means or linearly aligned in a direction extending generally normal to the direction of movement of said first ram means.

2. In the apparatus of claim 1 further including drill string receiving means having a throughbore receiving said drill strings therethrough, said throughbore being coaxially aligned with the bore of said preventer and having a cross-sectional area substantially greater than the combined outer diameters of said pair of drill strings, said receiving means having said first and second positioning means associated therewith.

3. In the apparatus of claim 2 wherein said throughbore is generally circular and substantially the same diameter as the inner diameter of said drill pipe, and said first and second positioning means in said first position are disposed out of said throughbore.

4. In the apparatus of claim 1 wherein each of said first ram means include generally planar drill string abutting surfaces thereon extending substantially across the diameter of said throughbore, the midpoint of each planar abutting surface being generally equidistant from the central longitudinal axis of said throughbore.

5. In the apparatus of claim 4 wherein each of said second ram means extend substantially across the diameter of said throughbore and said orienting means includes each of said opposed second ram means having a first generally planar drill string abutting surface, a second generally arcuate drill string surface, and a third generally planar drill string abutting surface extending generally parallel to, but spaced from, said first planar abutting surface, the arcuate abutting surfaces of each of said pair of second ram means being configured substantially the same as a portion of the outer configuration of said drill strings, the arcuate abutting surfaces of each of said pair of second ram means being disposed opposite each other when in said second position with said drill strings disposed therebetween, with the first planar surface of one of said pair of said second ram means being disposed opposite the third planar surface of the other of said pair of second ram means when in said second position.

6. In the apparatus of claim 5 wherein said portion of said outer configuration of said drill strings comprises approximately one-quarter of the outer configuration of said drill strings.

7. In the apparatus of claim 6 wherein said actuating means includes compressive force control means associated therewith for simultaneously moving each of said pair of first ram means substantially the same distance and at substantially the same rate of speed into abutting relation to said drill strings until the compressive force of said pair of first ram means reaches a compressive force substantially below the compressive force of said drill strings, then subsequently moving said pair of second ram means into abutting relationship to said drill strings when said first-mentioned compressive forces is reached.

8. Apparatus for orienting a pair of generally cylindrical drill strings or the like in a side-by-side abutting relationship within a blow-out preventer without crushing or deforming said drill strings wherein said preventer is connected to a subsea wellhead installation operatively connected to a vessel floating on the surface of a body of water, said apparatus comprising:

drill string receiving means having a throughbore receiving said drill strings therethrough, said throughbore having a cross-sectional area substantially greater than the combined outer diameters of said pair of drill strings;

first drill string positioning means operatively connected to said drill string receiving means and movable across said throughbore transverse to the longitudinal axes of the said drill strings from a first position out of engagement with said drill strings to a second position abutting thereagainst;

second drill string positioning means operatively connected to said drill string receiving means and movable across said throughbore transverse to the longitudinal axes of said drill strings and in a plane of movement spaced from the plane of movement of said first drill string orienting means in non-interfering relationship thereto, said second drill string positioning means being movable from a first position out of engagement with said drill strings to a second positioning abutting thereagainst; and actuating means operatively connected to all of said positioning means and said vessel for moving said first positioning means from said first position to said second position abutting against said pair of drill strings and retaining said first positioning means in abutting relation to said pair of drill strings until a predetermined compressive force of said first positioning means on said pair of drill strings is reached, then subsequently moving said second positioning means in a direction generally normal to the direction of movement of said first positioning means from said first position to said position abutting against said pair of drill strings to thereby alternately abut against and move said pair of drill strings within said throughbore until all of said positioning means simultaneously abut against said pair of drill strings and generally symmetrically align said pair of drill strips about the longitudinal axis of said throughbore and within said throughbore in a side-by-side relationship.

9. In the apparatus of claim 8 wherein said throughbore is generally circular and substantially the same diameter as the inner diameter of said drill pipe, and said first and second positioning means in said first position are disposed out of said throughbore.

10. In the apparatus of claim 8 wherein said first drill string positioning means comprises a pair of oppositely disposed first ram means having generally planar drill string abutting surfaces thereon extending substantially across the diameter of said throughbore, the midpoint of each planar abutting surface being generally equidistant from the central longitudinal axis of said throughbore.

11. In the apparatus of claim 10 wherein said second drill string positioning means comprises a pair of oppositely disposed second ram means extending substantially across the diameter of said throughbore and including orienting means on each of said second ram means for orienting said drill strings in a side-by-side relationship within said throughbore.

12. In the apparatus of claim 11 wherein said orienting means includes each of said second pair of ram means including a first generally planar drill string abutting surface, a second generally arcuate drill string abutting surface, and a third generally planar drill string abutting surface extending generally parallel to but spaced from said first planar abutting surface, the arcuate abutting surfaces of each of said pair of second ram means being configured substantially the same as a portion of the outer configuration of said drill strings, the arcuate abutting surfaces of each of said pair of second ram means being disposed opposite each other when in said second position with said drill strings clamped therebetween, with the first planar surface of one of said pair of second ram means being disposed opposite the third planar surface of the other of said pair of second ram means when in said second position, and the junction of the second arcuate surface and first planar abutting surface of one of said second ram means being approximately the same distance from the junction of the second arcuate surface and first planar abutting surface of the other of said second ram means, said same distance being slightly greater than the outer diameter of said drill strings when both said first and second ram means are in said second position.

13. In the apparatus of claim 12 wherein said portion of said outer configuration of said drill strings comprises approximately one-quarter of the outer configuration of said drill strings.

14. In the apparatus of claim 13 wherein said actuating means includes compressive force control means associated therewith for simultaneously moving each of said first pair of ram means substantially the same distance and at substantially the same rate of speed into abutting relation to said drill strings until the compressive force of said first pair of ram means reached a compressive force substantially below the compressive force of said drill strings, then subsequently moving said second pair of ram means into abutting relationship to said drill strings when said first-mentioned compressive force is reached.

15. A device for orienting a pair of generally cylindrical drill strings or the like comprising:

a housing having a throughbore of an area substantially greater than the combined outer diameters of said air of drill strings;

first drill string positioning means operatively connected to said housing and movable across said throughbore from a first position away from the center axis of said throughbore to a second position adjacent the center axis of said throughbore;

second drill string positioning means operatively connected to said housing and movable across said throughbore in a plane of movement spaced from the plane of movement of said first drill string positioning means in non-interfering relationship thereto and in a direction of movement generally normal to the direction of movement of said first positioning means, said second drill string orienting means being movable from a first position remote from the center axis of said throughbore to a second position adjacent the center axis of said throughbore; and actuating means operatively connected to all of said positioning means for moving said first positioning means from said first position to said second position and retaining said first positioning means in said second position, then subsequently moving said second positioning means from said first position to said second position.

16. In the device of claim 15 wherein said first positioning means comprises a pair of oppositely disposed first ram means each having generally planar surfaces generally equidistant from each other in said first position and lying in a plane generally parallel to a plane extending through the longitudinal axis of said throughbore, the midpoint of each of said planar surfaces being substantially equidistant from the central longitudinal axis of said throughbore.

17. In the device of claim 16 wherein said second positioning means comprises a pair of oppositely disposed second ram means, each of said second ram means including a first generally planar abutting surface, a second generally arcuate abutting surface, and a third generally planar abutting surface extending generally parallel to but spaced from said first abutting surface,, the arcuate abutting surfaces of each of said second ram means being configured substantially the same as a portion of the outer configuration of said drill strings, the arcuate abutting surfaces of each of said second pair of ram means being disposed opposite each other when in said second position and the first planar surface of one of said second pair of ram means being disposed opposite the third straight planar surface of the other of said second pair of ram means when in said second position.

18. In the device of claim 17 wherein said portion of said outer configuration of said drill strings comprises approximately one-quarter of the outer configuration thereof.

19. In the device of claim 18 wherein said actuating means includes compressive force control means associated therewith for simultaneously moving each of said first pair of ram means substantially the same distance and at substantially the same rate of speed until a predetermined compressive force is reached, then moving said second pair of ram means when said predetermined compressive force is reached.

20. A method for orienting a pair of drill strings, which extend from a vessel floating on the surface of a body of water down into a subsea wellhead installation, in a predetermined manner in the center of a bore through a blow-out preventer to facilitate closing off of the drill strings with respect to the wellhead at the blow-out preventer, said method comprising the steps of:

positioning said drill strings within a predetermined central zone of the bore through the blow-out preventer by bringing a pair of first opposed ram means into abutting engagement with said drill strings and moving said drill strings, via said abutting first ram means, to said predetermined central zone;

maintaining said drill strings in said predetermined central zone and in abutting relationship with said first ram means until a predetermined maximum compressive force of said first ram means on said drill strings is reached; and subsequently positioning said drill strings in a final centrally oriented position within the bore through the blow-out preventer by bringing a pair of second opposed ram means into abutting engagement with said drill strings and moving said drill strings to said final centrally oriented position whether said drill strings, when positioned in said central zone, are linearly aligned in a direction extending generally parallel to the direction of movement of said first ram means or linearly aligned in a direction extending generally normal to the direction of movement of said first ram means.

21. In the method of claim 20 including the step of sealing off said drill strings with respect to said subsea wellhead by actuating said blow-out preventer after positioning said drill strings in said final centrally oriented position.

22. A method for orienting a pair of generally cylindrical drill strings or the like in a predetermined manner within the center of a bore through a blow-out preventer without crushing or deforming said drill strings wherein said preventer is coupled to a subsea wellhead installation coupled to a vessel floating on the surface of a body of water to a subsea wellhead installation, said method comprising the steps of:

connecting a housing having a throughbore substantially greater in diameter than the combined outer diameters of said drill strings to both said riser and said preventer with said drill strings extending through both said throughbore and the bore of said blow-out preventer;

moving an oppositely disposed first pair of ram means across said throughbore transverse to the longitudinal axis of said throughbore into abutting relationship with said drill strings;

maintaining said first pair of ram means in abutting relationship with said drill strings until a predetermined compressive force of said first pair of ram means on said drill strings is reached;

subsequently moving a second pair of oppositely disposed ram means across said throughbore transverse to the longitudinal axis of said throughbore and in a direction generally normal to the direction of movement of said first pair of ram means until said second pair of ram means abuts against said drill strings; and alternatively moving said first and said second pair of ram means until said drill strings are moved into a side-by-side relationship generally symmetrically aligned within the center of the bore of said aligned blow-out preventer about the longitudinal axis thereof.

23. In the method of claim 22 including the step of actuating said blow-out preventer to thereby seal off said drill strings from said wellhead after moving said drill strings into the center of the bore of said blow-out preventer.

24. In the method of claim 22 wherein the step of moving a first pair of ram means includes the step of moving a first pair of ram means having generally planar drill string abutting surfaces into abutting relationship to said drill strings, the midpoint of each of said planar surfaces being generally equidistant from the central longitudinal axis of said throughbore.

25. In the method of claim 22 wherein each of said second pair of ram means includes a first generally planar drill string abutting surface, and a third generally planar drill string abutting surface extending generally parallel to, but spaced from, said first planar abutting surface, and the step of moving said second pair of drill string ram means includes the step of moving the first planar surface of one of said second pair of drill string ram means in a direction opposite the third planar surface of the other of said second pair of drill string ram means, and moving the arcuate surface of one of said second pair of drill string ram means in a direction opposite the arcuate surface of the other of said second drill string ram means; and the step of alternatively moving includes the step of alternately moving said drill strings until said drill strings are located between substantially the midpoint of said planar surfaces of said first pair of ram means and between the arcuate surfaces of said second pair of ram means.

26. In the method of claim 25 including the step of controlling the compressive force of sad first and second pair of ram means exerted on said drill strings.

27. In the method of claim 26 wherein the step of controlling the compressive force includes the step of moving said first pair of ram means substantially the same distance and at substantially the same rate of speed into abutting relationship to said drill strings until the compressive force of said first pair of ram means reaches a compressive force substantially below the compressive force of said drill strings; and then moving said second pair of drill string ram means into abutting relationship to said drill strings.

* * * * *